US005513930A

United States Patent [19]

Eathorne

[11] Patent Number: 5,513,930

[45] Date of Patent: May 7, 1996

[54] UNDERWATER SERVICING DEVICE

[76] Inventor: Russell J. Eathorne, 19 Joiner Street, Milville, W.A., 6156, Australia

[21] Appl. No.: 129,137

[22] PCT Filed: Apr. 10, 1992

[86] PCT No.: PCT/AU92/00160

§ 371 Date: Dec. 3, 1993

§ 102(e) Date: Dec. 3, 1993

[87] PCT Pub. No.: WO92/18379

PCT Pub. Date: Oct. 29, 1992

[30] Foreign Application Priority Data

Apr. 11, 1991 [AU] Australia ..... PK5577
Jul. 25, 1991 [AU] Australia ..... PK7421

[51] Int. Cl.[6] ..... B63B 59/00

[52] U.S. Cl. ..... 114/222

[58] Field of Search ..... 405/11–13, 14, 405/188, 191; 114/222

[56] References Cited

U.S. PATENT DOCUMENTS

| | | | |
|---|---|---|---|
| 3,768,265 | 10/1973 | Brouillette | 405/12 |
| 3,857,249 | 12/1974 | Kelly et al. | 405/11 |
| 3,906,572 | 9/1975 | Winn . | |
| 4,058,082 | 11/1977 | Winn | 118/9 |
| 4,095,378 | 6/1978 | Urakami . | |
| 4,270,484 | 6/1981 | Shimatani et al. . | |
| 4,462,328 | 7/1984 | Oram | 114/222 |
| 4,697,536 | 10/1987 | Hirata | 114/222 |
| 5,174,222 | 12/1992 | Rogers | 114/222 |

FOREIGN PATENT DOCUMENTS

| | | | |
|---|---|---|---|
| 1227167 | 6/1959 | France . | |
| 2442763 | 11/1978 | France . | |
| 1038209 | 8/1966 | United Kingdom . | |
| 1092133 | 11/1967 | United Kingdom . | |
| 1225338 | 3/1971 | United Kingdom . | |
| 1545232 | 10/1976 | United Kingdom . | |
| 2020231 | 11/1979 | United Kingdom . | |
| 2040193 | 8/1980 | United Kingdom | 114/222 |
| 2135571 | 9/1984 | United Kingdom | 114/222 |
| 2181040A | 4/1987 | United Kingdom . | |
| WO84/03869 | 10/1984 | WIPO . | |
| WO86/00860 | 2/1986 | WIPO . | |

OTHER PUBLICATIONS

International Search Report (PCT/AU92/00160) dated Jul. 17, 1992.

*Primary Examiner*—Ramon S. Britts
*Assistant Examiner*—Frederick L. Lagman
*Attorney, Agent, or Firm*—Merchant, Gould, Smith, Edell, Welter & Schmidt

[57] ABSTRACT

An underwater servicing device includes a substantially hollow housing (30) having an open face (32) whereby the configuration of the open face (32) substantially conforms to the surface of an article to which the housing (30) is to be mounted. A seal (34) is provided about the peripheral edge of the open face (32), as is a pump (42) in fluid communication with the interior of the housing (30) that is capable of evacuating fluid from therewithin and removing such evacuated fluid externally of the device. A mechanism for moving the device from one location on the article to another is also provided, the mechanism being capable of raising the device away from the article. An adjustable air supplier is provided that is capable of allowing air to enter the interior of the housing (30). As water is evacuated from the interior of the housing (30) and air enters, the positive pressure of water external to the housing (30) urges the device against the article such that the seal (34) contacts the article, the further and continuing evacuation of water resulting in a substantially water tight sealing engagement between the seal (34) and the article.

22 Claims, 8 Drawing Sheets

UNDERWATER SERVICING DEVICE

This invention relates to an underwater servicing device. In particular, the invention relates to a device which can be used for the servicing of surfaces of underwater facilities such as a ship's hull, underwater pylons such as offshore oil platform pylons, or the like.

The earliest forms of servicing devices for ships were all configured to only be usable above the water line or when a ship was in dry dock. As ships became larger, having a vastly increased submerged surface area, and became more difficult to contain in a dry dock, there was a need for the development of underwater servicing devices.

Most of the traditional underwater servicing devices were of necessity relatively small in order to be able to provide enough thrust, usually by way of impellers or propellors, in order to retain the devices in place during their operation. Furthermore, the majority of these devices were only capable of washing or cleaning the particular surface, or at best painting the surface with a "curable-in-water" paint that does not require a dry environment for a satisfactory finish.

In order to provide larger underwater servicing devices, there have been provided alternative versions that utilise strong magnetic fields to attach the devices to the metallic surfaces of ship's hulls. In particular, electro magnets have been used in order to allow the magnetic fields to be switched on and off such that the device is readily movable.

However, there are two significant difficulties with underwater servicing devices that rely on electromagnetic attraction for their attachment. Firstly, as the entire device is regularly located under water there is a significant risk of the failure of the electrics that power the electromagnets. While the total avoidance of the use of electrics in such underwater devices is generally not possible, it is preferred to keep those electrics to a minimum to minimise the risk of electric failure. In this situation, a failure in the sole means for attaching the device to a ship's hull would clearly be fatal to the operation of the device and would possibly result in the loss of the device. Secondly, and perhaps more importantly, such devices are clearly only usable where a strong magnetic attraction may be obtained between the electro magnet and the surface to be cleaned. Thus, if a ship's hull is of a non metallic material such as concrete or fibreglass, or if a pylon is constructed of concrete or timber, then such a device would not be usable. Furthermore, many ship's hulls are thickly encrusted with crustaceans and water borne particles and the like, thus limiting the ability to gain adequate attraction between the magnet and the metallic hull.

Therefore, there is clearly a need for an underwater servicing device that is capable of providing a substantially dry environment to allow the use of any marine type paint and which may be successfully adapted and utilised for the servicing, including washing, painting and cleaning, of any underwater structure regardless of its material of construction and regardless of the thickness or composition of any encrusted coatings.

An aim of the present invention is to provide such an underwater servicing device that overcomes or at least partly alleviates the difficulties referred to above.

The present invention provides an underwater servicing device comprising a substantially hollow housing having an open face whereby the configuration of the open face substantially conforms to the surface of an article to which the housing is to be mounted, sealing means being provided about the peripheral edge of the open face, pumping means in fluid communication with the interior of the housing being capable of evacuating fluid from therewithin and removing such evacuated fluid externally of the device, means for moving the device from one location on the article to another, said moving means also being capable of raising the device away from the article, and an adjustable air supply means capable of allowing air to enter the interior of the housing, wherein as water is evacuated from the interior of the housing and air enters, the positive pressure of water external to the housing urges the device against the article such that the sealing means contacts the article, the further and continuing evacuation of water resulting in a substantially water tight sealing engagement between the sealing means and the article.

The present invention also provides an underwater servicing device comprising a substantially hollow housing having an open face whereby the configuration of the open face substantially conforms to the surface of an article to which the housing is to be mounted, sealing means being provided about the peripheral edge of the open face, pumping means in fluid communication with the interior of the housing being capable of evacuating fluid from therewithin and removing such evacuated fluid externally of the device, means for moving the device from one location on the article to another, said moving means also being capable of raising the device away from the article, an adjustable air supply means capable of allowing air to enter the interior of the housing, and a servicing means in the interior of the housing for servicing the surface of the article, wherein as water is evacuated from the interior of the housing and air enters, the positive pressure of water external to the housing urges the device against the article such that the sealing means contacts the article, the further and continuing evacuation of water result in a substantially water tight sealing engagement between the sealing means and the article allowing the operation of the servicing means on a first area of the surface of the article, the device then being capable of being flooded to nearly equalise the internal land external pressures such that the moving and raising means is able to raise the device away from the article allowing the device to be moved to another area of the surface of the article, the pumping means being operable while raising and moving the device to ensure that the internal and external pressures do not equalise.

Further, the present invention also provides a method of operating an underwater servicing device according to any one of claims 1 to 15, said method including the steps of: placing the device alongside the article such that the open face is adjacent thereto; evacuating water from within the housing by activation of the pumping means while allowing air to enter the housing via the adjustable air supply means, such that as water is evacuated from the interior of the housing and the air enters, the positive pressure of water external to the housing urges the device against the article such that the sealing means contacts the article, the further and continuing evacuation of water resulting in a substantially watertight sealing engagement between the sealing means and the article; servicing the article; flooding the interior of the housing, and; operating the moving and raising means to firstly raise the device away from the article, breaking the seal therebetween, and then to move the device to another location.

Further still, the present invention provides a method of operating an underwater servicing device according to any one of claims 21 to 37, said method including the steps of: placing the device alongside the article such that the open face is adjacent thereto; evacuating water from within the housing by activation of the pumping means while allowing air to enter the housing via the adjustable air supply means, such that as water is evacuated from the interior of the housing and the air enters, the positive pressure of water external to the housing urges the device against the article such that the sealing means contacts the article, the further and continuing evacuation of water resulting in a substantially watertight sealing engagement between the sealing means and the article; servicing the article; flooding the interior of the housing, while operating the pumping means to ensure that the internal and external pressures do not equalise and; operating the moving and raising means to firstly raise the device away from the article, breaking the seal therebetween, and then to move the device to another location.

In one form of the invention, the interior of the housing may be left substantially empty and the device may be of such a size that it may be entered by one or more divers who may themselves service the article by washing, cleaning, painting or the like. However, in a preferred form of the invention, the interior of the housing includes mechanical means for servicing the surface of the housing, in the form of a servicing head which may include high pressure water sprays, paint applicators, a heating and drying means, or any such suitable means.

Preferably, the servicing head is carried upon a guide means provided along the length of the housing and is associated with a drive means which may effect longitudinal movement of the servicing head along the length of the housing such that the head passes in close proximity to the surface of the article.

The housing of the underwater servicing device may also include a purge valve, either associated with, for example, the adjustable air supply means, or provided independently thereof, which is capable of being activated to allow the interior of the housing to be flooded when the servicing operation is complete and the device needs to be moved to another location. On activation of the purge valve, the pumping means is preferably simultaneously closed to prevent the further evacuation of the flooding water, as is the air supply means to restrict the flow of air into the interior of the housing. In this way, the positive pressure of water external to the housing is lessened and the moving and raising means may be activated to break the sealing engagement between the sealing means and the article to allow the device to be raised therefrom.

Once this sealing engagement is broken, the pumping means may be restarted, albeit at possibly a slower rate, the purge valve may be closed and the device may be moved to another location.

Once the device is in the other location the pumping means may be fully powered to recommence evacuation of the interior of the housing, the air supply means may be reactivated to supply air thereto, and the moving and raising means may be activated to lower the device towards the surface of the article as the positive pressure of water external to the housing increases to again urge the device against the article such that the sealing means contacts the article, wherein further evacuation of water results in the substantially water tight sealing engagement between the sealing means and the article.

The moving and raising means of the device is preferably provided in the form of an hydraulically operated and electrically powered wheeled chassis adapted to be simultaneously raised or lowered by hydraulic rams and to be powered by a single hydraulic or electric motor with a chain drive connecting respective axles. The wheels of the raising and moving means may be any suitable type of wheels that provide suitable traction between the device and the surface of the article.

The sealing means of the housing preferably comprises one or more resilient materials configured so as to provide a substantially water tight sealing engagement with the surface of the article, regardless of the configuration of the surface itself. In particular, the sealing engagement must be such as to cope with protuberances, irregularities or interruptions that are common with articles of the type to which this device may be used.

In one preferred form of sealing means for use with the invention, a plurality of layers arranged substantially parallel to the surface of the article to which they will be engaging are provided on the peripheral edge of the housing, each having a different density. Preferably, softer resilient materials are provided as the outermost layer while harder resilient materials are provided as the innermost layer closest to the housing itself. Furthermore, the outermost layers are preferably relatively tough and are abrasion and tear resistant to avoid damage thereto on movement of the device.

In another preferred form of sealing means for use with the invention, a plurality of layers of resilient material of possibly varying thicknesses are arranged on the peripheral edge of the housing to extend away from the housing in a direction perpendicular to the surface of the article. In this form, the layer of resilient material outermost from the interior of the housing preferably extends furthest from the housing towards the surface of the article. Successive layers of resilient material are progressively shorter and are preferably separated by small blocks of resilient material, thus providing finger-like elements as the sealing means.

In order to assist in the understanding of the invention, three preferred embodiments will now be described in relation to the accompanying drawings. However, it must be appreciated that the following description is not to limit the generality of the above description. In the drawings.

The first and second embodiments are directed to a device which can be used for cleaning or painting the hull of a ship while the ship is still located in a body of water, while the third embodiment is directed to a device which can be used for the underwater cleaning of a pylon. In this respect, it must be appreciated that the inventive concept may be easily adapted for use in any such situation where underwater servicing is required.

Figure 1:
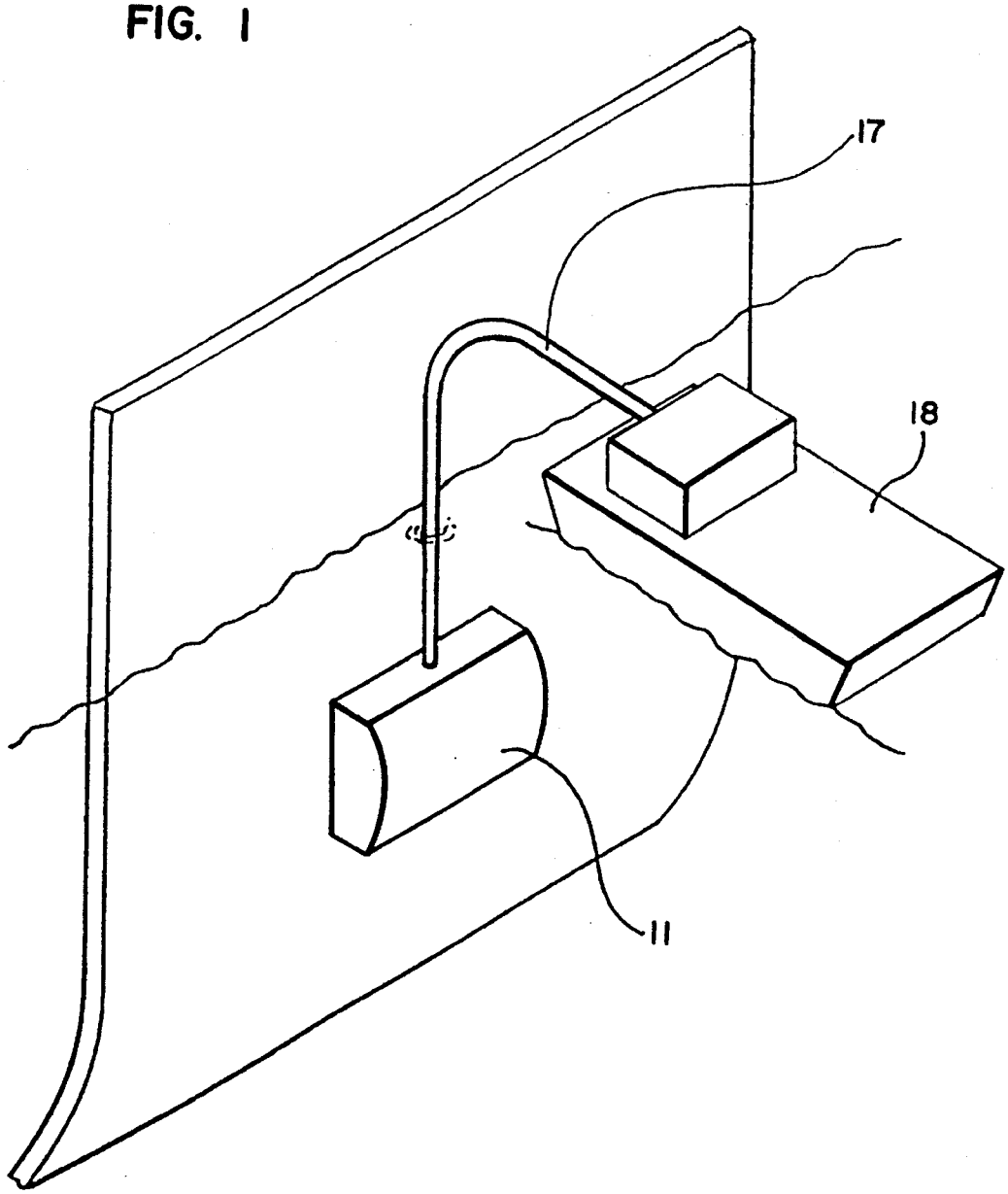
FIG. 1 is a schematic view of a first embodiment in use in servicing a ship's hull.
Figure 2:
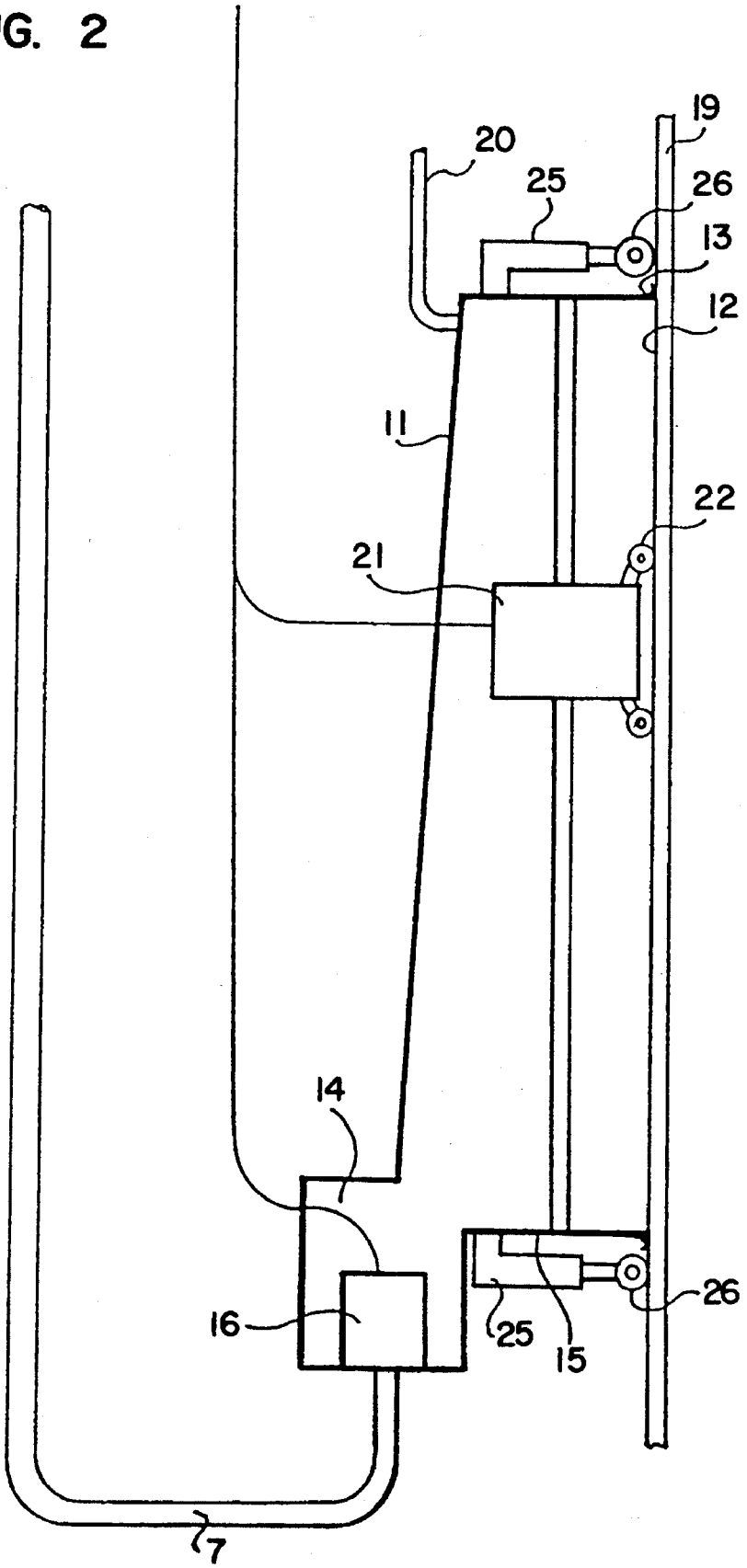
FIG. 2 is a cross sectional view of the embodiment of FIG. 1 in use.

The first embodiment illustrated in FIGS. 1 and 2 comprises a substantially hollow and generally cubic housing 11 which is formed with an open face 12 and which is provided with a seal 13 around the peripheral edge of the open face to ensure sealing engagement between the housing and the ship's hull when in use. The housing in the case of this embodiment is substantially rectangular in plan.

The side of the housing which would be lowermost when the housing is fixed to a ship's hull is associated with a sub-housing which extends beyond the lower edge 15 of the housing and provides a sump 14. The sump accommodates a pumping means in the form of a pump 16 which evacuates water from the housing 11 via the sump 14 and delivers it to an outlet line 17 which extends to the servicing vessel. In this way, it is possible for any water extracted from the device to be filtered or cleaned prior to return to the ocean.

In use, the housing 11 is supported from a service vessel 18 to lie alongside the ship's hull 19 such that the open face is in close engagement therewith and the sump 14 is lowermost. Water is then extracted from within the housing by activation of the pump 16 while air is allowed to flow into the housing via an adjustable air supply means in the form of a vent line 20 extending from the surface. Thus, as water is evacuated from within the housing, the air is delivered into the housing. As a result of such, water pressure on the exterior of the housing forces it towards and into sealing engagement with the side of the ship's hull where it is retained by the further evacuation of water from within the housing. On the interior of the housing 11 being emptied of water, the exposed surface of the ship's hull 19 which is overlaid by the housing can then be serviced. Such servicing can be effected by personnel entering into the space within the housing through suitable hatchways.

Alternatively, and as shown in FIG. 2, the housing can accommodate a servicing head 21 which supports appropriate equipment which will clean encrustations from the surface of the hull and subsequently treat the surface as required. Such equipment may comprise high pressure water jets with or without particulate blasting means. The water and debris which is generated by such jets is extracted from the sump 14 by the pump 16.

The servicing head 21 may also be provided with a paint application means which can be activated after the surface of the hull has been cleaned. The servicing head may be further provided with means which can promote the drying or setting of the paint which has been applied to the surface and such means may comprise infra red or ultra violet radiation sources, air blowers or the like. Such drying means may also be used to substantially dry the surface prior to painting.

The servicing head 21 is carried upon a guide means provided along the length of the housing and is associated with a drive means (not shown) which will effect longitudinal movement of the servicing head along the length of the housing such that the head passes in close proximity to the surface. The servicing head 21 may be associated with a support means in the form of a wheel or like means which ensures that an appropriate spacing is provided between the servicing head and the surface being treated to maximum effect. In addition, the profile of the servicing head may be shaped to accommodate the configuration of the hull in the region engaged by the housing.

In use, the servicing head is moved along the length of the guide means and is caused to pass over the surface of the hull covered by the housing to effect the cleaning of the surface of the hull. On completion of the cleaning of the hull it is again passed along the length of the guide means to wash the surface with fresh water prior to drying the washed surface. The servicing head may then be opened to apply paint to the surface of the hull. The servicing head may then again be caused to pass along the guide means and over the surface to effect the drying or setting of the paint.

Figure 3:
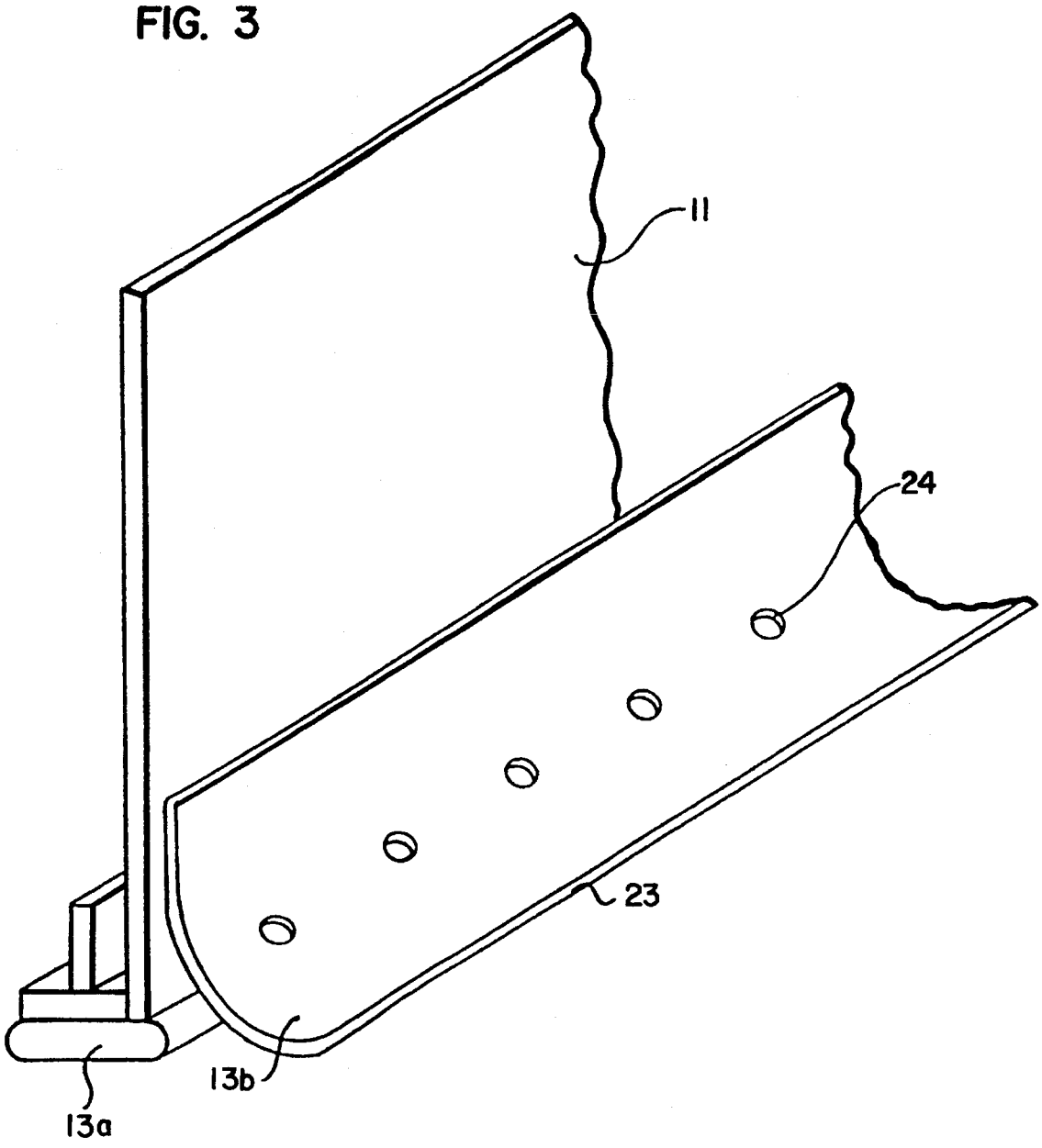
FIG. 3 is a schematic sectional perspective view of the seal according to the embodiment of FIG. 1.

Illustrated in FIG. 3 is one form of a sealing means suitable for use with this invention. In this respect, a sealing means 13 is provided around the peripheral edge of the open face of the housing of the first embodiment. The sealing means 13 comprises a contact seal **13*a* which will provide a full sealing engagement between the open face of the housing and the ship's hull when the open face is brought into close abutting engagement with the ship's hull. The sealing means 13 also comprises a strip seal 13*b* which is fixed to the side of the housing 11 along one edge, and which has a width such that it extends beyond the edge of the open face whereby on the housing being forced away from the ship's hull, in a manner which will be described below, the free edge of the strip seal 13*b* maintains an engagement with the ship's hull despite the lack of contact between the contact seal 13*a* and the ship's hull. The strip seal 13*b* is formed with a series of apertures 24 which allows for a restricted flow of water to the housing on disengagement of the contact seal 13*a* from the ship's hull, while the free edge 23 of the strip seal 13*b* is maintained in engagement with the ship's hull. The flow rate of water which flows through the apertures 24 is controlled by the number and size of the apertures 24 to an extent that the flow of water can be handled by the pump 16**.

The sides of the housing support a moving and raising means in the form of a set of extendable legs 25 which may be controlled hydraulically or by any other suitable means. The lower ends of the legs 25 are each provided with a set of support wheels 26 to support the housing from the side of the ship's hull. The degree of extension of the legs 25 is such that on extension of the legs the contact seal **13*a* will be brought out of engagement with the ship's hull but the free edge 23 of the strip seal 13*b*** will be retained in contact.

After a portion of the ship's hull which is covered by the housing 11 has been treated, the housing can be moved over the ship's hull by extending legs 25 to bring the contact seals **13*a* out of engagement with the ship's hull, allowing for controlled flooding of the housing through the apertures 24 provided in the strip seal 13*b*. The degree of flooding can be controlled through the continued operation of the pump 16 which serves to reduce the force exerted on the housing by the water pressure. By activation of drive motors which may be provided on the wheel 26, or by any other suitable means, the housing 11 can then be moved to another location on the ship's hull. When the desired position has been reached the extendable legs 25 are retracted bringing the contact seals 13*a* into engagement with the ship's hull and on evacuation of all of the water from within the housing 11** and the entry of air thereto, the servicing of the newly exposed area of the hull can be effected.

If desired, the air pressure within the housing 11 can be controlled by use of suitable compressors in order to control the thrust which is applied by the housing onto the hull as a result of water pressure.

Figure 4:
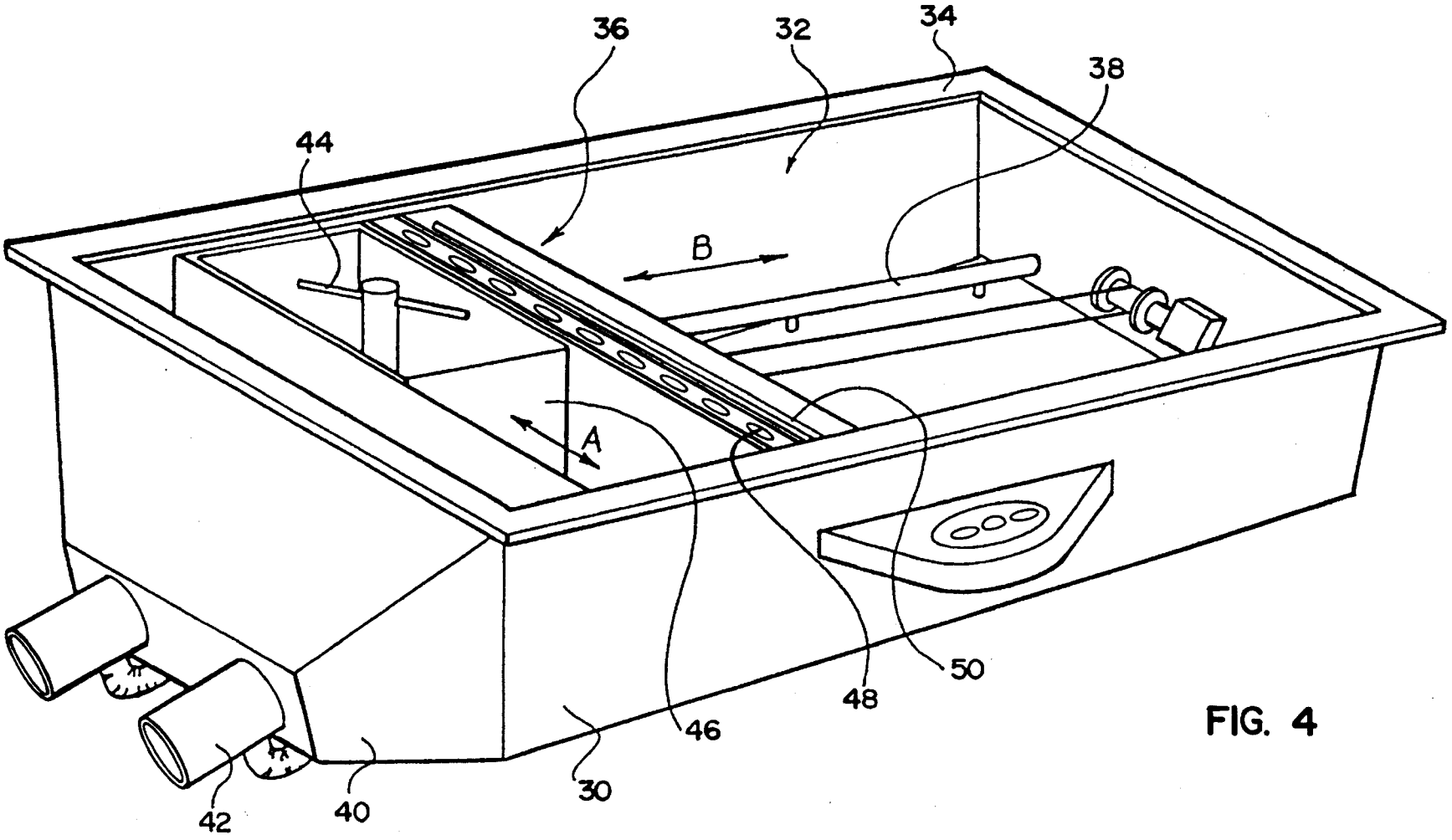
FIG. 4 is a schematic perspective view of a second embodiment viewed from below.

A second preferred embodiment of the invention is illustrated in FIGS. 4 to 7. FIG. 4 shows an underwater servicing device having a substantially hollow housing 30 as viewed from adjacent the open face 32 of that housing 30. The housing 30 is similar in overall configuration to the housing 11 illustrated in FIGS. 1 and 2, and is provided with a sealing means 34 around the peripheral edge of the open face. The housing 30 includes servicing equipment 36 therewithin which is slidable along guide means 38. The housing 30 also includes a sub-housing in the form of a sump 40 which accommodates a pumping means in the form of pumping outlets 42 for extraction of water and debris and any other material to be removed from within the housing 30.

Figure 5:
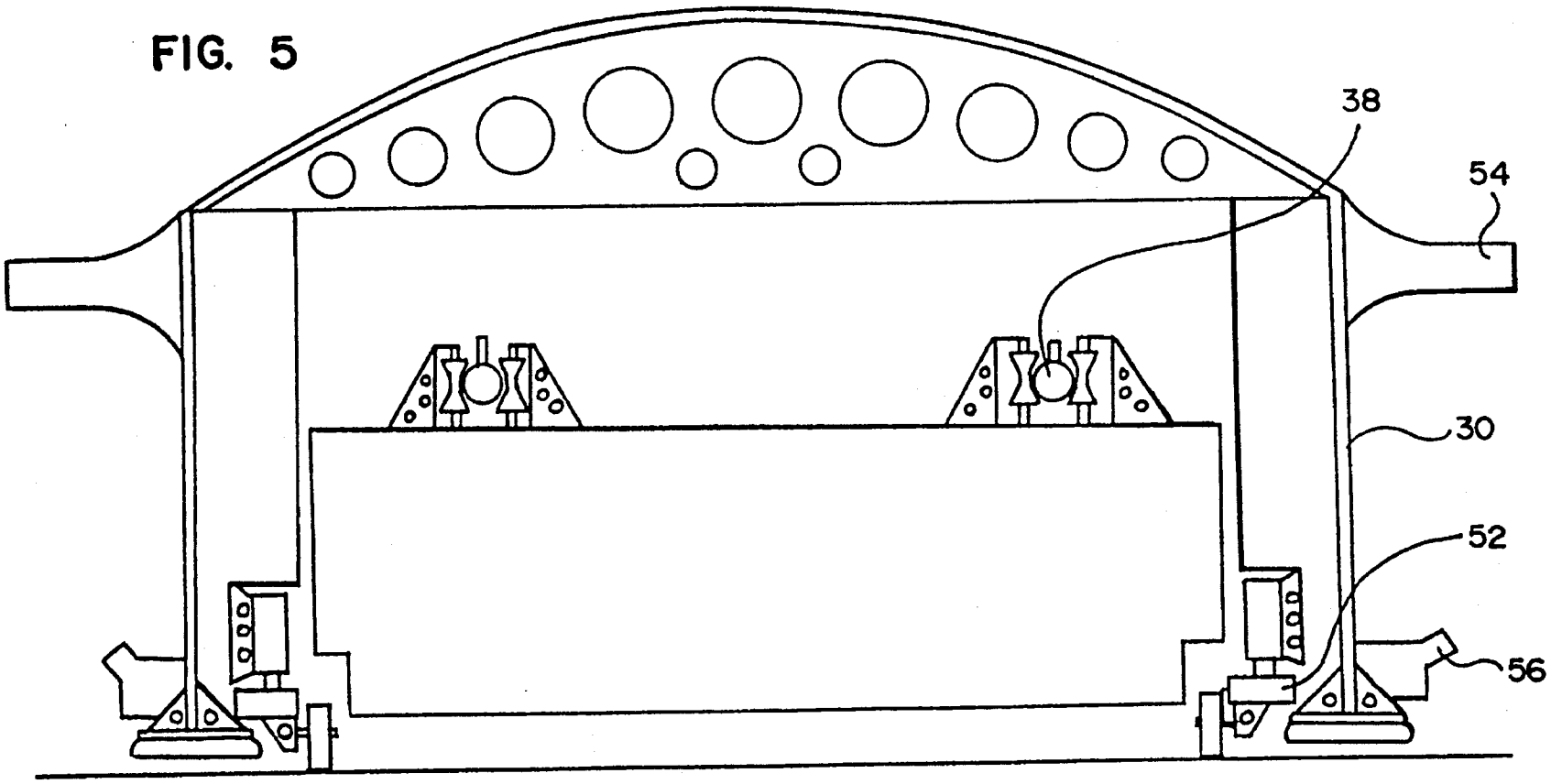
FIG. 5 is a cross sectional view of the embodiment of FIG. 4.
Figure 6:
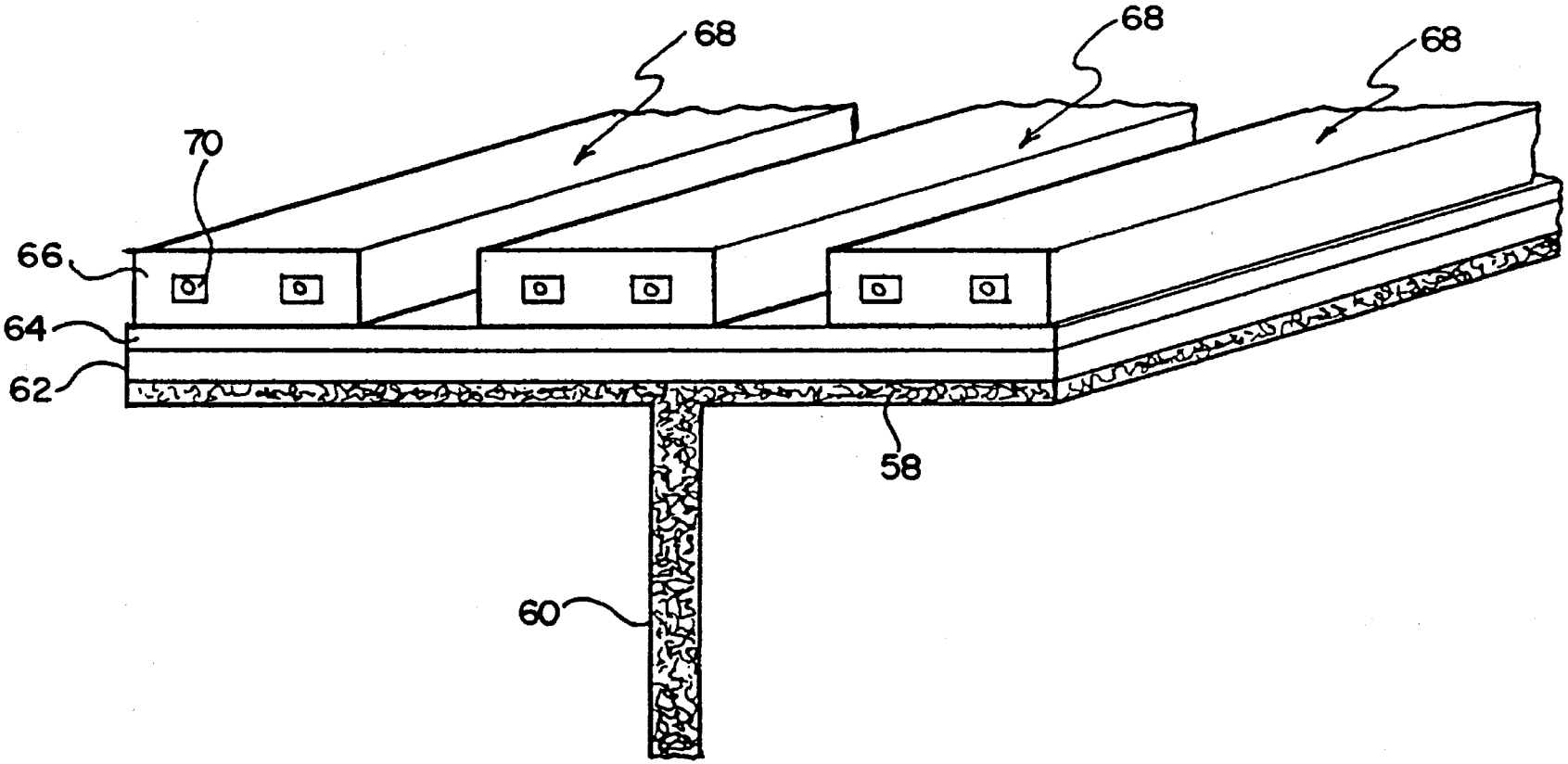
FIG. 6 is a schematic sectional view of a seal according to the embodiment of FIG. 4.
Figure 7:
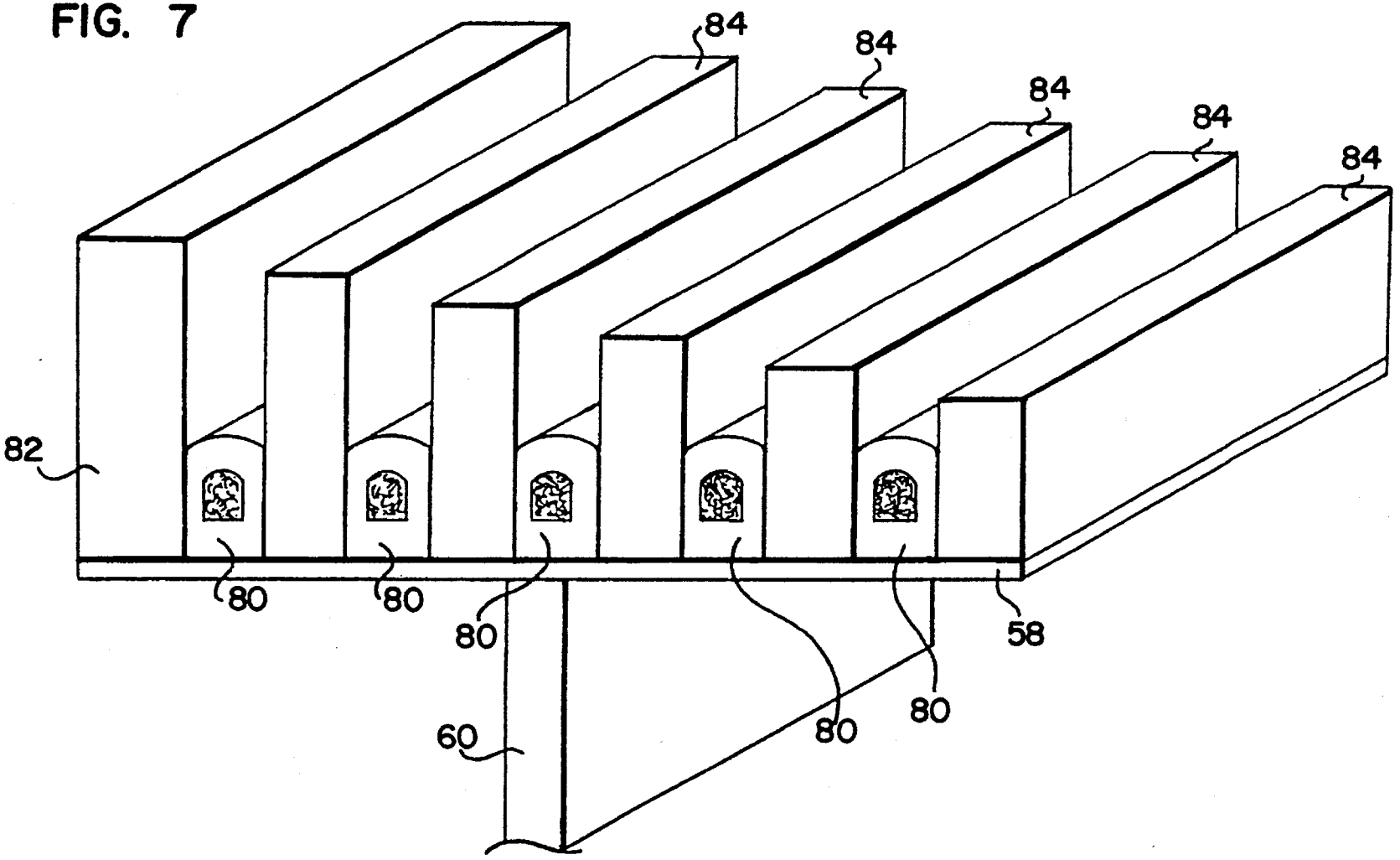
FIG. 7 is a schematic sectional view of a second type of seal for use with the embodiment of FIG. 4.

It will be understood that various of the features of this embodiment have not been included in the underwater servicing device illustrated in FIG. 4 but have been included in FIGS. 5, 6 and 7 for the sake of clarity.

However, FIG. 4 does illustrate a preferred configuration for the servicing equipment 36. This preferred configuration comprises a high pressure water spray system 44 in the form of a rotatable device having two outwardly extending spray arms with single jets at the ends thereof. The spray system 44 is enclosed within a movable housing 46 which is slidably movable in the direction of arrows A to cover the entire width of the underwater servicing device itself. The servicing equipment 36 also includes paint application means 50 in the form of a single laterally extending spray arm having a plurality of spray jets thereon. The servicing equipment 36 further comprises means for drying or setting the paint after application to the hull of a ship or for drying the surface of the hull prior to applying the paint thereto. The drying means 48 is shown in the form of a plurality of air blowers. It will be understood that the spray arms and jets referred to above for both the cleaning and painting phases may be replaced by a plurality of oscillating spray nozzles if so desired. Such oscillating nozzles may be particularly beneficial for use on sharply carved surfaces.

As described above in relation to the first embodiment of the invention, in use the servicing equipment 36 is moved along the length of the guide means (in the direction of arrows B) and is caused to pass over the surface of the hull covered by the housing to effect the cleaning and subsequent painting of the surface of the hull. This may be effected in a single run by the servicing equipment 36, or may alternatively be effected by a number of runs, with each run utilising only one of the components of the servicing equipment, or with multiple runs being provided for each component. For instance, the first run of the servicing equipment along the guide means may activate only the water spray system 44 to pressure clean the hull, followed by a second run which may wash, at a lower pressure and with fresh water, the hull of any matter abrasively removed by the high pressure cleaning. A third run may dry the hull of any excess water, followed by a fourth run which may apply paint to the hull, and a fifth and final run which may dry the paint thus applied.

Once such actions are completed, the underwater servicing device is then ready to be moved into the next position on the hull. The movement of the underwater servicing device according to this second embodiment will now be described in relation to FIGS. 5, 6 and 7, where like features of the underwater servicing device have been referred to by like reference numerals.

As illustrated in FIG. 5, the housing 30 has guide means 38 therein which in turn have the servicing equipment 36 slidably mounted thereon. A seal 34 is located around the edge of the open face 32 of the housing 30 to ensure a substantially watertight sealing engagement between the housing and the ship's hull when the underwater servicing device is in use. FIG. 5 also illustrates an internal lift and drive system, which comprises main thrusters 54 and seal thrusters 56 which will be described below.

Prior to the first placement of the underwater servicing device upon the hull of a ship, the device is placed closely adjacent to that hull and the main pumps connected to pumping outlets 42 are activated to evacuate water from within housing 30. At the same time, air is allowed to enter the space left by the removal of the water so that a vacuum is not created between the housing 30 and the ship's hull. As the water is withdrawn, the seal 34 creates a preliminary seal between the housing 30 and the ship's hull so that the positive pressure of the water external to the housing urges the underwater servicing device against the hull of the ship such that it is retained in place by a substantially watertight seal caused by the further evacuation of the water. The operation of the servicing equipment 36 may now occur as described above.

The pumps servicing the pumping outlets 42 remain operational during the servicing by the servicing equipment 36 so that water delivered thereby and any debris or paint resulting from the servicing is continually removed through the pumping outlets 42.

The movement of the underwater servicing device to a second location on the ship's hull is initiated by the flooding of the housing. In this respect, the air supply to the housing is stopped and reversed to allow the air to escape from the housing back to the air supply to be replaced by water. In this respect, the shape of the housing of the device is preferably such that all of the air will accumulate at the uppermost point thereof and will, at that point, be able to exit the housing. With all of the air exited there is a minimal effect on the ballast of the device during moving.

The positive pressure required to retain the device against the hull of the ship during flooding is primarily maintained by maintaining the operation of the pumps to keep the interior of the housing as a region of lower pressure. However, this positive pressure is also maintained by activating both the main and seal thrusters 54 and 56. In this form, the main thrusters are simply propellors which create a flow away from the hull of the ship to urge the device towards the hull of the ship, while the seat thrusters 56 are in the form of small pumps which draw water into an inlet to be directed away from the hull of the ship via an outlet, and which assist in forcing the device towards the hull of the ship. In an alternative form, only the main thrusters 54 may be provided and the seal thrusters 56 may be omitted.

As indicated above, at some point during flooding, the main pumps may be activated to begin pumping water out of the housing. At the same time, the moving and raising means is activated to raise the seal of the housing from contact with the hull of the ship to allow water to enter into the housing past the seal. There remains however sufficient pressure differential between the inside and outside of the device to retain the device in engagement with the hull while being moved. Of course, the air supply would need to be closed at this time so that air is not drawn into the housing through those valves. If desired, a three-way valve may be included in the main pumps which allows the water pumped during the moving operation to be jettisoned away from the device to provide an additional thrust, rather than being pumped to the surface as in the servicing operation.

The underwater servicing device may then be moved to a second location where the moving and raising means may be withdrawn to allow the seal 34 to engage the hull of the ship, while the air lines are again opened and the pumps again act to evacuate the water from within the housing 30 via the pumping outlets 42 to create a suitable seal so that the servicing operation may start again. At this time the three-way valve may be switched so that the water is again pumped to the surface.

Where the underwater servicing device is to be used in a horizontal position such that its open face is uppermost there may need to be provided additional means for applying positive pressure during the flooding operation. In this regard, the pressure applied by the main and seal thrusters may not be adequate, and ballast tanks or the like may need to be provided within the housing. These ballast tanks may normally be full of water but may be capable of being evacuated of that water in the above situation by compressed air or the like. Indeed, it may be found in some circumstances that the positive pressure provided by the buoyancy of the ballast tanks is sufficient to retain the device in place without a need for the additional thrusters. Such means is preferably in the form of a valve which is operable in conjunction with the activation of the moving and raising means 52. Such means may also of course be provided integral with the pumping system or the pumping outlets 42.

With regard to ballast, it is preferable for ballast tanks to be provided that are capable of being adjusted to assist in maintaining the correct buoyancy of the device. Indeed, the device preferably has a neutral buoyancy at any given depth, so the ballast conditions will need to be altered for operation at different depths.

Illustrated in FIG. 6 is a preferred arrangement for the seal 34 shown in FIGS. 4 and 5. This preferred arrangement may also be utilised as the seal 13*a* shown in the embodiment of FIG. 3. The seal 34 preferably includes a plurality of layers of resilient material having varying densities. Preferably, softer resilient materials are provided as the outermost layer while harder resilient materials are provided as the inner most layer closest to the bracket 58 of the housing wall 60. The nature of the resilient material allows for a reasonable seal to be made between the housing and the hull of a ship irrespective of whether there are interruptions or protuberances on the hull. Preferably the resilient materials, or at least the outermost layers thereof, are relatively tough and are abrasion and tear resistant to avoid damage thereto on movement of the device.

In the preferred form illustrated in FIG. 6, three layers of resilient material are provided, namely first and second complete layers 62 and 64 and a third layer 66. The third layer 66 is shown in the form of three separate strips of material 68 each having two longitudinally extending apertures 70 therein. The apertures 70 may include therewithin a further softer resilient material such as a latex type material, or may include a viscous liquid such as glycerine or the like, or may remain hollow.

The presence of the three strips 68 further ensures that a reasonable seal is provided between the housing and the hull of a ship regardless of the presence of any interruptions or protuberances.

Illustrated in FIG. 7 is yet a further preferred arrangement for the seal 34 shown in FIGS. 4 and 5. The seal 34 includes a plurality of layers of resilient material having various heights away from the bracket 58 of the housing wall 60. Preferably, each of the layers of resilient material are of a relatively soft resilient material, with the separating blocks 80 being of a relatively hard resilient material. However, the blocks 80 may themselves be hollow such that they too can be filled with a viscous liquid such as glycerine. Such a liquid filled block allows a seal to be readily created about virtually any type of protuberance.

Layer 82 is located on the outermost side of the bracket 58, away from the interior of the housing, and extends the greatest distance away from the bracket 58 of each of the remaining layers, also being of greatest thickness. The successive layers 84 are each progressively shorter and extend progressively less distances away from the bracket 58. Furthermore, each of the layers 84 are somewhat thinner than layer 82.

The configuration illustrated in FIG. 7 has been found to provide an extremely efficient seal over virtually any type of surface. It also provides a seal that is readily broken when necessary when the device of this invention is operated in the manner described above.

Figure 8:
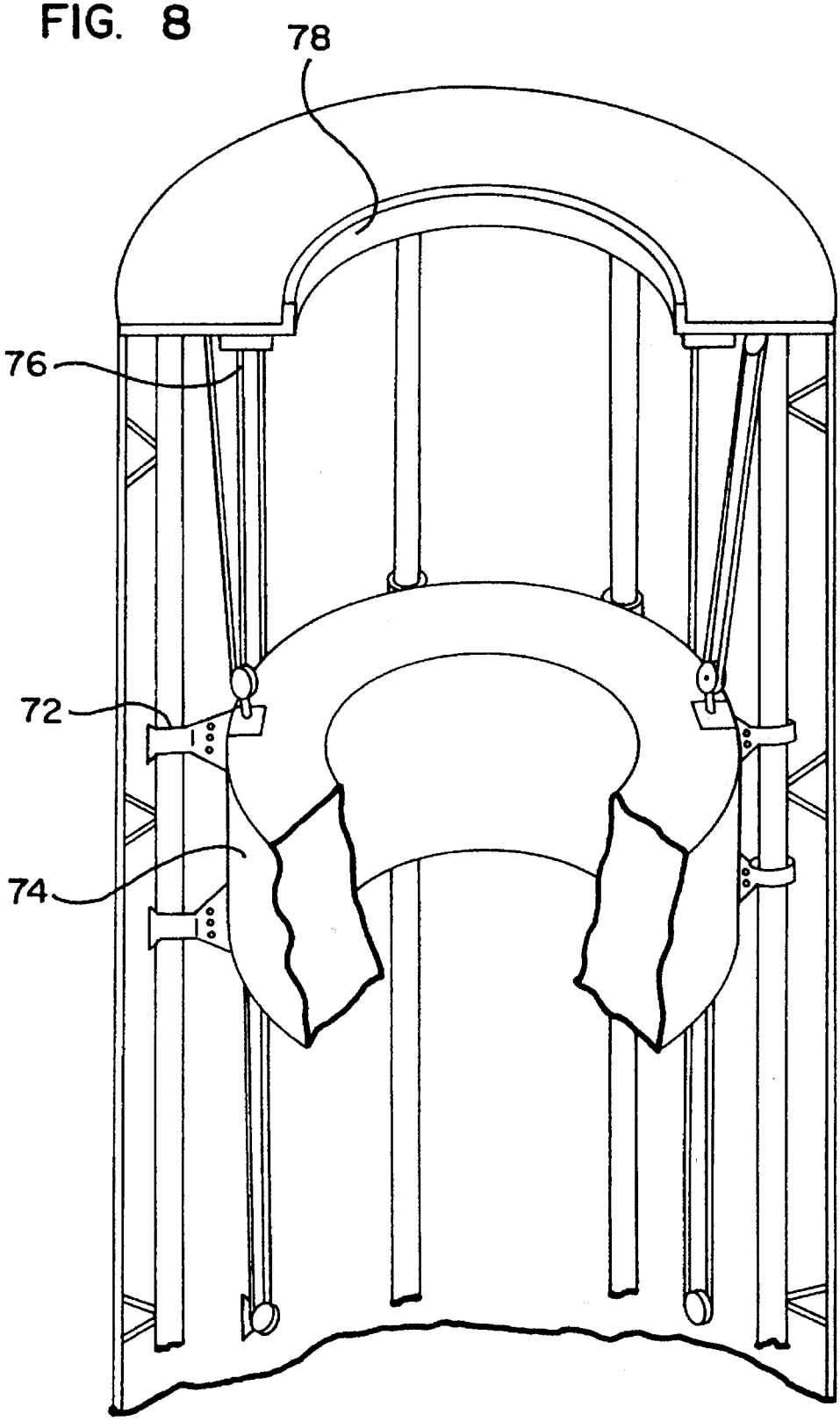
FIG. 8 is a schematic view of a third embodiment of the invention.

In an alternative embodiment, the housing may be configured to service pylons by having an annular configuration where the inner axial face is open and has a diameter corresponding to the diameter of the pylon. In addition the housing may have any desired configuration to service particular surfaces. Furthermore, the housing may comprise a plurality of sections which are pivotally and sealingly interconnected to enable the housing to accommodate for variations in profile. An example of such a housing is generally illustrated in FIG. 8 where there are provided guide means 72 having slidably mounted thereon servicing equipment 74 shown here activated by a pulley system 76. The housing illustrated in FIG. 8 is of course only one half of the housing that would be required to form the underwater servicing device, and that one half may be pivotally attached via a hinge or the like along edge 78 to another similar half. The further features as described above which are preferred for inclusion with the first and second embodiments of the invention may also be utilised with this third alternative embodiment.

Furthermore, each of the embodiments of the present invention may be provided in a modular form so as to be readily adaptable to any size. In this way, the device of the invention may be provided having respective end modules that carry all of the internal mechanisms required for the device, together with a number of intermediate modules that may be connected between the end modules to give a device of any required length. The intermediate modules need only have sufficient components to allow the servicing head of the device to pass therethrough and to allow the connection of any components that require connecting between the respective end modules.

The device may also be adapted so as to be capable of operating over and allowing for surfaces that are curved to a degree such as would normally be found on a ship's hull. In this form the housing of the device is preferably articulated so as to allow for a continuous seal with the surface. The articulation may be effected by having a plurality of slidably and sealingly overlapping housing portions, and by adapting the internal components to allow for a suitable clearance from the surface to continue operation. Of course, a separate, totally adapted device would be needed for drastic changes in curvature.

Thus, it can be seen from the above description of the present invention that an underwater servicing device may be provided that does not rely on electromagnetic attraction and is thus usable on any type of underwater material for the washing, cleaning or painting and the like of that material. The various servicing actions may be conducted in a wet or dry environment, and any environmental concerns may be met by being able to extract all of the waste products from the device to a service craft nearby if necessary. The device of the invention is relatively uncomplex in its electrical and mechanical componentry and can be readily adapted for use in any required situation. Clearly however, the device is most beneficial for the underwater servicing of ship's hulls.

Finally, it will be appreciated that-there may be other modifications and variations to the various configurations as described above that may also fall within the scope of the present invention.

I claim:

1. An underwater servicing device of a type suitable for use relative to a generally vertical surface submerged in and exposed to water, comprising a substantially hollow housing having an open face whereby the configuration of the open face substantially conforms to the surface, sealing means being provided about the peripheral edge of the open face, pumping means in fluid communication with the interior of the housing being capable of evacuating fluid from therewithin and removing such evacuated fluid externally of the device, means for moving the device from one location on the surface to another, said moving means also being capable of raising the device away from the surface, an adjustable air supply means capable of allowing air to enter the interior of the housing, and a servicing means in the interior of the housing for servicing the surface, wherein as water is evacuated from the interior of the housing and air enters, the positive pressure of water external to the housing urges the device against the surface such that the sealing means contacts the surface the further and continuing evacuation of water resulting in a substantially water tight sealing engagement between the sealing means and the surface allowing the operation of the servicing means on a first area of the surface, the device then being capable of being flooded to nearly equalise the internal and external pressures such that the moving and raising means is able to raise the device away from the surface allowing the device to be moved to another area of the surface of the article, the pumping means being operable while raising and moving the device to ensure that the internal and external pressures do not equalise.

2. A device according to claim 1 including external thrusters operable to create a flow away from the article to urge the device towards the surface to provide additional thrust.

3. A device according to claim 1 wherein the pumping means includes valving to allow the water pumped during the moving operation to be jettisoned away from the device to provide additional thrust.

4. A device according to claim 1 wherein the servicing means is a mechanical means and is in the form of a servicing head.

5. A device according to claim 4 wherein the servicing head includes high pressure water sprays, paint applicators, and a heating and drying means.

6. A device according to claim 4 wherein the servicing head is carried upon a guide means provided along the length of the housing and is associated with a drive means which may effect longitudinal movement of the servicing head along the length of the housing such that the head passes in close proximity to the surface.

7. A device according to claim 1 including a purge valve, either associated with the adjustable air supply means, or provided independently thereof, which is capable of being activated to allow the interior of the housing to be flooded when the servicing operation is complete and the device needs to be moved to another location.

8. A device according to claim 1 wherein the moving and raising means is an hydraulically operated and hydraulically powered wheeled chassis adapted to be simultaneously raised or lowered by hydraulic rams and to be powered by a single electric motor with a chain drive connecting respective axles.

9. A device according to claim 1 wherein the sealing means comprises one or more resilient materials configured so as to provide a substantially watertight sealing engagement with the surface, regardless of the configuration of the surface itself.

10. A device according to claim 9 wherein the sealing means includes a plurality of layers arranged substantially parallel to the surface such that softer resilient materials are provided as the outermost layer while harder resilient materials are provided as the innermost layer closest to the housing itself.

11. A device according to claim 10 wherein the sealing means includes first and second complete layers of resilient material and a third layer, said third layer comprising three separate strips of resilient material, each having two longitudinally extending apertures therein.

12. A device according to claim 11 wherein each of the apertures are filled with a viscous liquid.

13. A device according to claim 9 wherein the sealing means includes a plurality of layers of resilient material of possibly varying thicknesses arranged to extend away from the housing in a direction perpendicular to the surface.

14. A device according to claim 13 wherein the layer of resilient material outermost from the interior of the housing extends furthest from the housing towards the surface, and successive layers of resilient material are progressively shorter and are separated by small blocks of resilient material.

15. A device according to claim 14 wherein each of said small blocks has a longitudinally extending aperture therein filled with a viscous liquid.

16. A device according to claim 1 wherein the side of the housing that is lowermost when the housing is fixed to a ship's hull includes a sub housing extending below the lower edge of the housing and providing a sump, and the pumping means is configured so as to evacuate water from the housing via said sump.

17. A device according to claim 1, wherein the interior of the housing is substantially empty and the device is of a size such that it may be entered by one or more divers who themselves become the servicing means and service the surface by at least one of washing, cleaning, and painting the surface.

18. A method of operating an underwater servicing device relative to a generally vertical surface submerged in and exposed to water, said method including the steps of: placing the device alongside the surface such that a hollow housing opens toward the surface; evacuating water from within the housing by activation of a pumping means while allowing air to enter the housing via an adjustable air supply means, such that as water is evacuated from the housing and the air enters, the positive pressure of water external to the housing urges the device against the surface such that a sealing means contacts the surface, the further and continuing evacuation of water resulting in a substantially watertight sealing engagement between the sealing means and the surface; servicing the surface; flooding the housing, while operating the pumping means to ensure that the internal and external pressures do not equalise and; operating a moving and raising means to firstly raise the device away from the article, breaking the seal therebetween, and then to move the device to another location.

19. A method according to claim 18 wherein external thrusters are operated while moving the device to assist in urging the device against the surface.

20. A method according to claim 18 wherein the water pumped by the pumping means while flooding and moving the device is jettisoned externally of the device to assist in urging the device against the surface.

21. A method according to claim 18 wherein the housing is flooded by opening a purge valve to allow water into the housing and to allow air to escape while temporarily ceasing operation of the pumping means to at least lowering the rate of the pumping means.

22. A method according to claim 18 wherein the servicing of the surface includes washing, cleaning or painting the article, either manually by divers or mechanically by a servicing head.

* * * * *